United States Patent [19]

Wallasvaara

[11] 4,375,802

[45] Mar. 8, 1983

[54] STOVE

[76] Inventor: Jorma Wallasvaara, Kurjenmäentie 3, 20700 Turku 70, Finland

[21] Appl. No.: 215,863

[22] Filed: Dec. 12, 1980

[30] Foreign Application Priority Data

Dec. 14, 1979 [FI] Finland ..... 793916

[51] Int. Cl.[3] ..... A21B 1/00

[52] U.S. Cl. ..... 126/21 A; 126/214 R

[58] Field of Search ..... 126/21 A, 214 R, 126, 126/131, 61, 63, 67, 110 R, 39 J, 39 K

[56] References Cited

U.S. PATENT DOCUMENTS

| | | | |
|---|---|---|---|
| 1,572,661 | 2/1926 | Lindemann | 126/214 R |
| 3,592,180 | 7/1971 | Kweller et al. | 126/214 R |
| 3,663,798 | 5/1972 | Speidel et al. | 126/39 J |
| 3,973,551 | 8/1976 | Caselani et al. | 126/21 A |
| 4,010,341 | 3/1977 | Ishammar | 126/21 A |

FOREIGN PATENT DOCUMENTS

| | | | |
|---|---|---|---|
| 16332 | 11/1926 | Netherlands | 126/39 K |

*Primary Examiner*—Daniel J. O'Connor

*Attorney, Agent, or Firm*—McAulay, Fields, Fisher, Goldstein & Nissen

[57] ABSTRACT

The invention concerns a stove comprising a burner, a combustion chamber, transport and exit ducts for the combustion gases, and at least one heating unit, such as a hearth plate or an oven. According to the invention, the stove comprises warm air duct with inlet and outlet and a blower, arranged to circulate air into said warm air duct to be heated by the heating unit and out from said duct. The stove may consist for instance of a lid lowerable over the hearth plate so that the warm air duct becomes confined between the lid and the hearth plate. When the stove comprises an oven, the warm air duct may conduct the air to be heated on the other hand into the oven and on the other hand into the intermediate space confined between the outer surface of the transport duct for the combustion gases.

5 Claims, 3 Drawing Figures

STOVE

Figure 1:
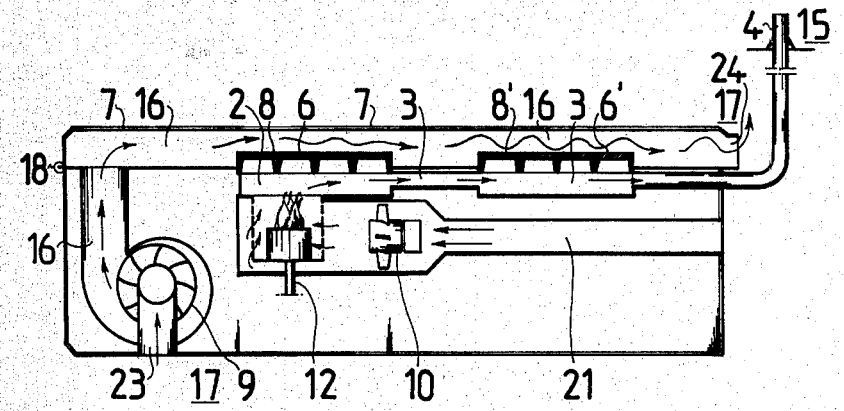

The present invention concerns a stove comprising: a burner; a combustion chamber wherein the burner is placed; transport and exit ducts for the combustion gases; and at least one heating unit which is heatable with the aid of the heat generated in the burner and is mainly intended for food preparation.

In particular, the invention concerns stoves working with liquid or gaseous fuel and intended for boating, camping and equivalent leisure time uses.

Stoves meant for boat, camping and house trailer use are most often open stoves, implying that the flame is open and the combustion gases remain in the indoor space. The fuels used are comparatively pure fuels, such as L.P. gas, alcohols or oil-based fuels. In the open stove, the fuel burns and produces carbon dioxide and water vapour. Similarly as the cooking ranges, the boat, camping and house trailer stoves meant for warming purposes are of open construction and are based on use of the fuels mentioned.

Open fire stoves cause certain inconveniences. Since the combustion gases remain in indoor space, the interior air humidity increases owing to the water vapour in the combustion gases. Furthermore, the voiding of the combustion gases into interior space increases the ventilation requirements owing to the consumption of oxygen in the combustion process and to the smoke and soot production in the combustion gases and the carbon dioxide. Open fire stoves are moreover dangerous in poorly ventilated rooms where the reduced oxygen content and the increase of the carbon dioxide loading cause, as a result of incomplete combustion, the formation of dangerous carbon monoxide. The increase of humidity and the risk of carbon monoxide formation are major detriments, especially in those cases in which the stove is used for prolonged periods, e.g. for continuous heating and for the drying out of interior space.

The object of the present invention is to eliminate the drawbacks mentioned. The object of the invention is to provide a stove intended in particular for boating, camping and house trailer use and which is safe and will not raise the humidity or carbon dioxide content of the room air.

It is a further object of the invention, to provide a stove which is suitable for food preparing and heating purposes both.

Regarding the features characteristic of the invention, reference is made to the claim section.

The invention is based on a stove construction comprising a substantially gas-tight warm air duct and a blower which have been fitted to conduct air, if desired, through a heating unit, such as a hearth plate or an oven, to the indoor space to the purpose of air warming in such a manner that the stove may be used also towards room warming. If desired, the electric blower may be stopped with a switch, whereat the stove may be used conventionally towards the preparation of food. Hereby the stove of the invention has a dual function.

In the stove of the invention, the combustion gases are conducted from the combustion chamber through mainly gas-tight transport and exit ducts into free atmosphere, whereby the water vapour and carbon dioxide produced in the combustion and the smoke, soot and carbon monoxide, if any, have no access to the indoor space and thus will not cause any increase of water vapour and/or carbon dioxide content in the room air, nor any smoke or carbon monoxide.

Figure 2:
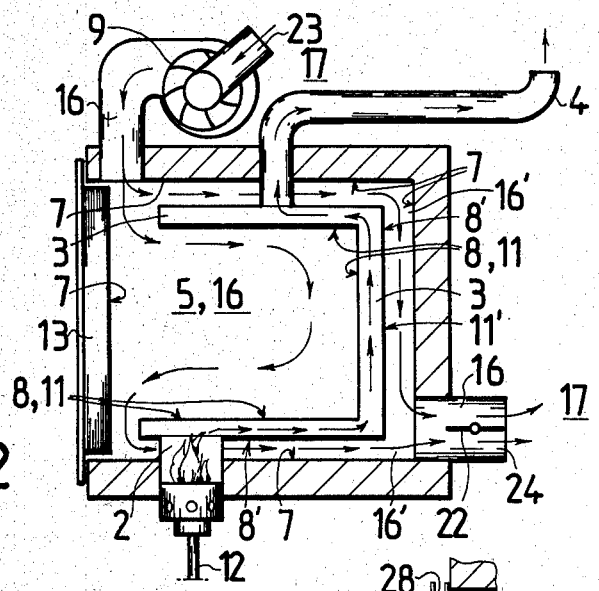
Figure 3:
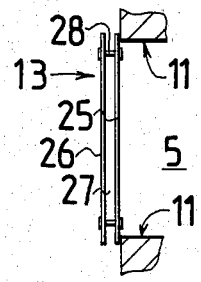

The invention is described in the following in detail with the aid of embodiment examples, with reference being made to the attached drawing, wherein:

FIG. 1 presents, in elevational view and sectioned, a cooking range as taught by the invention, FIG. 2 presents, in elevational view and sectioned, another stove as taught by the invention, by a schematic diagram, and FIG. 3 presents, in elevational view and sectioned, the oven door of a third stove as taught by the invention.

The stove depicted in FIG. 1 comprises the substantially gas-tight elements: combustion chamber 2 comprising burner 1, combustion gases transport duct 3, combustion gases exit duct 4, and heating units 6, 6', which in the embodiment presented consist of hearth plates, that is of hearth plates and hearth chamber composed thereinunder. The combustion chamber 2, the hearth chamber disposed in conjunction therewith and composed under the preceding hearth plate 6, the transport duct 3 transporting combustion gases from said hearth chamber to the latter hearth plate 6', that is to the latter hearth chamber disposed thereinunder, the said latter hearth plate with its hearth chamber and the exit duct 4 removing the combustion gases from the latter hearth plate to free atmosphere 15 constitute in combination a substantially gas-tight entity, The combustion chamber 2 has been disposed in conjunction with the first hearth plate 6 in such manner that the heat generated in the combustion chamber goes partly into the first hearth plate, partly along with the combustion gases to the latter hearth plate, and partly along with the combustion gases further to free atmosphere 15. The stove further comprises a combustion air blower 10 for conducting combustion air by the duct 21 into the combustion chamber 2, and members 12 for conducting the fuel to the burner.

The stove depicted in FIG. 1 comprises furthermore a lid 7, which forms a jacket surface and has been disposed to be placed over the hearth plates 6 so that a warm air duct 16 is produced between the lid and the hearth plates limited to the combustion chamber 2 and the combustion gases transporting duct 3. Furthermore, the stove comprises a heating air blower 9 for conducting air into said duct 16 through inlet 23 and out from said duct through outlet 24 to the indoor space 17. In the warm air duct 16 air is conducted past the hearth plates 6, 6', i.e. heat conduction surfaces 8, 8', whereat heat is transferred to the air from the burner 1 through the conduction surfaces. If desired the blower 9 is stopped, the lid 7 is removed, whereby the hearth plates are exposed and may be used for preparing food. The stove is hereby bifunctional. The stove may be used for heating, in which case the lid 7 is lowered upon the hearth plates 6, 6' as described and the air to be heated is circulated through the warm air duct 16 with the aid of the blower 9, wherein the hearth plates warms the air. Whenever desired, the blower 9 is stopped and the lid 7 removed, whereby the hearth plates are exposed and may be used for preparing food.

When the stove of FIG. 1 is in use, the combustion air blower 10 conducts the combustion air into the combustion chamber 2 while at the same time the members 12 conduct fuel, such as kerosene, butane or equivalent fuel, to the burner 1. The burner 1 is ignited with the aid of an electric igniter. The combustion gases arising in the course of combustion are conducted from the combustion chamber into the transport duct 3, wherein the heat contents of the combustion gases transfer into the hearth plate with the aid of heat transfer ribs or of a heat transfer surface. Thereafter the somewhat cooled combustion gases are carried further to the second hearth plate 6'. The second hearth plate is heated owing to the heat transferred from the combustion gases to the hearth plate through heat transfer ribs and/or a heat transfer surface. From the second hearth plate, the combustion gases go to the exit duct 4 and further to free atmosphere 15. In heating use, the heat which has transferred from the burner and from the combustion gases to the hearth plates is transferred from the hearth plates to the air flowing past in the duct 16 through heat conduction surfaces 8, 8' and, together with the air, into the indoor space, such as a boat, camping caravan, tent, dwelling, etc.

The embodiment of the invention shown schematically in FIG. 2 comprises an oven 5 confined by walls 11 and oven door 13 and adjoining to the combustion chamber 2. The system of combustion gas transport ducts 3 is similarly confined by the walls 11, i.e. heat conduction surfaces 8, of the oven 5, and it conducts combustion gases to the exit duct 4 from the combustion chamber 2 past said conduction surfaces. The heat generated in the combustion chamber 2 is partly transferred into the oven through the walls 11, partly along with the combustion gases into the transport duct 3 to transfer from the combustion gases partly into the oven 5. Part of the heat generated in the combustion chamber 2 is further transported along with the combustion gases to the exit duct 4 and into free atmosphere 15. As taught by the invention, the stove comprises a warm air duct 16 and warm air blower 9, which have been provided to conduct air from indoor space 17 through inlet 23 into the duct 16, past the heat conduction surfaces 8 of the oven, and further into the indoor space 17 through outlet 24. Jacket 7 defines outer warm air duct 16' between the outer wall 8', 11' of the combustion gases transporting duct 3 and said jacket. Blower 9 has been provided to conduct air that one desires to heat into the oven 5, 16 and into said outer warm air duct 16'. To the air circulating in the oven 5, 16 and in the duct 16', heat is transferred through the walls of the combustion gas transport ducts 3, i.e. through heat conduction surfaces 8, 8'. If desired, the blower 9 may be stopped, whereby the stove may also be employed mainly for food preparation only, wherein the duct 16 may be closed by damper 22. For heating use, the blower 9 is started, whereby the stove operates as a heater.

In FIG. 3 the oven door 13 of an oven of the present invention comprises inner plate 25 and outer plate 26, forming between them intermediate space 27 which is open upwards and downwards. The plates 25, 26 made for instance of glass, are joined together by shanks 28. The oven door 13 has been hinged to a side wall 11 of the oven 5. Due to the double plate construction: air will rise into the intermediate space 27, the air will be warmed by the heat transferred from the oven through the inner plate 25, and the air will isolate the outer plate against the heat of the oven thus increasing the heating effectiveness of the oven and preventing the heating of the outer plate of the oven door.

If desired, the stove of the invention may comprise one or several hearth plates and an oven. There may be a separate burner with combustion chamber for each hearth plate or oven, or the stove may comprise one burner with combustion chamber, disposed to heat the oven and the hearth plates partly directly and partly by conducting the combustion gases to pass by the oven and hearth plates. In the case of stoves intended for boat and travel use, the combustion air is drawn with advantage from outdoors, through a combustion air duct disposed in the vicinity of the exit duct, whereby a balanced combustion system is obtained.

The embodiment examples are meant to illustrate the invention without in any way restricting it, and the invention may vary within the scope of the claims following hereinbelow.

I claim:

1. A stove comprising:

a combustion chamber;

a burner disposed in said combustion chamber;

substantially gas-tight transport and exit ducts for combustion gases;

heating means juxtaposed to and in heat exchange relationship with said combustion chamber and said transport duct through a heat conduction surface, said heating means being heated by heat generated by said burner and primarily intended for food preparation;

substantially gas tight warm air duct means including an inlet thereto and an outlet therefrom and a blower, said warm air duct means cnducting air into said heating means past said heat conduction surface for heating air;

a jacket surface, said warm air duct means being confined between said heating means and said jacket surface;

said heating means including at least one hearth plate constituting a heating unit adjoining on and in heat exchange relationship with said combustion chamber and said transport duct for said combustion gases; and a hearth plate lid constituting said jacket surface positionable over said hearth plate and confining said warm air duct means between said lid and said hearth plate.

2. The stove as claimed in claim 1, wherein said heating means comprises two hearth plates, one of said hearth plates adjoins said combustion chamber, and the other of said hearth plates adjoins said combustion gases transport duct; and further comprising a lid forming said jacket surface lowerable over both said hearth plates for confining said warm air duct means between said lid and said hearth plates.

3. The stove as claimed in claim 1, wherein said heating means includes at least two hearth plates, and said jacket surface covers said hearth plates for confining said warm air duct means between said jacket surface and said hearth plates.

4. A stove comprising:

a combustion chamber;

a burner disposed in said combustion chamber;

substantially gas-tight transport and exit ducts for combustion gases;

a heating unit including at least one hearth plate, said heating unit adjoining on and in heat exchange relationship with said combustion chamber and said transport duct for said combustion gases;

substantially gas-tight warm air duct means including an inlet thereto and an outlet therefrom and a blower, said warm air duct means conducting air into said heating unit past said hearth plate; and a hearth plate lid including a jacket surface positionable over said hearth plate and confining said warm air inlet thereto from the surroundings and said outlet therefrom to the surroundings and said blower, said jacket confining said warm air duct means as air is conducted into said heating unit past said hearth plate for heating air.

5. The stove as claimed in claim 4, wherein said heating unit includes two hearth plates.

* * * * *